US006723004B1

(12) United States Patent
Florian

(10) Patent No.: US 6,723,004 B1
(45) Date of Patent: Apr. 20, 2004

(54) WEIGHT SHIFT TRAINING APPARATUS FOR GOLFERS

(76) Inventor: Raymond J. Florian, 14440 Elwell, Belleville, MI (US) 48111

( * ) Notice: Subject to any disclaimer, the term of this patent is extended or adjusted under 35 U.S.C. 154(b) by 0 days.

(21) Appl. No.: 10/282,794

(22) Filed: Oct. 30, 2002

(51) Int. Cl.[7] ..... A63B 69/36
(52) U.S. Cl. ..... 473/270
(58) Field of Search ..... 473/270, 269, 473/266, 272, 271, 218, 278

(56) References Cited

U.S. PATENT DOCUMENTS

| | | | | | |
|---|---|---|---|---|---|
| 2,189,613 | A | | 2/1940 | Paulsen | |
| 4,023,810 | A | * | 5/1977 | Lorang | 473/218 |
| 4,037,847 | A | | 7/1977 | Lorang | |
| 4,164,352 | A | * | 8/1979 | O'Brien | 473/218 |
| 4,355,810 | A | * | 10/1982 | Rydeck | 473/218 |
| 4,805,913 | A | * | 2/1989 | Bott | 473/218 |
| 4,915,387 | A | * | 4/1990 | Baxstrom | 473/218 |
| 5,150,902 | A | | 9/1992 | Heisler | |
| 5,163,686 | A | * | 11/1992 | Bergman | 473/218 |
| 5,197,739 | A | * | 3/1993 | Johnson, III | 473/271 |
| 5,263,863 | A | | 11/1993 | Stefani et al. | |
| 5,318,290 | A | * | 6/1994 | Sawyer | 473/217 |
| 5,762,565 | A | * | 6/1998 | Milam et al. | 473/271 |
| 5,810,673 | A | | 9/1998 | Castleberry | |
| 5,976,027 | A | | 11/1999 | Kachmar | |
| 6,077,169 | A | * | 6/2000 | Florian | 473/278 |
| 6,482,102 | B2 | * | 11/2002 | Grabowski | 473/270 |

* cited by examiner

*Primary Examiner*—Steven Wong
*Assistant Examiner*—Nini F. Legesse
(74) *Attorney, Agent, or Firm*—Charles W. Chandler

(57) ABSTRACT

A golf training apparatus comprising a base pad with indicia for locating a golfer's feet for different golf swings, and a pair of footpads, one of which rocks on a fulcrum and the other is disposed in a non-rocking position for teaching a golfer a proper weight shift during his swing.

6 Claims, 5 Drawing Sheets

WEIGHT SHIFT TRAINING APPARATUS FOR GOLFERS

BACKGROUND AND SUMMARY OF THE INVENTION

This invention relates to a training device for teaching a golfer the proper way to shift his lower body during a golf swing, depending upon the club that he is using. A successful golf swing depends upon several factors including the proper location of the golfer's feet with respect to the location of the ball. This, in turn, depends upon the head of the practice club. Different clubs require that the golfer position his feet in different locations with respect to the ball. Typically the leading foot of the golfer is disposed in a position that depends upon the location of the pin, and the trailing foot position is dictated by the club configuration.

Some prior art references pertaining to practicing a proper weight shift include U.S. Pat. No. 5,976,027 issued Nov. 2, 1999 to John Kachmar for "Golf Swing Stance Stabilizer"; U.S. Pat. No. 5,810,673 issued Sep. 22, 1998 to David M. Castleberry for "Golf Swing Improvement Device"; U.S. Pat. No. 5,263,863 issued Nov. 23, 1993 to Nicholas J. Stefani et al. for "Weight Shift Trainer for Golfers"; U.S. Pat. No. 5,150,902 issued Sep. 29, 1992 to Doyle J. Heisler for "Golfer Weight Distribution Measurement System"; U.S. Pat. No. 4,037,847 issued Jul. 26, 1977, to Walter R. Lorang for "Golf Swing Training Apparatus"; U.S. Pat. No. 2,189,613 issued Feb. 6, 1940 to Guy D. Paulsen for "Golf Practicing Apparatus".

In general such prior fails to fully train a proper weight shift with a selected golf club.

The broad purpose of the present invention is to provide a golf weight shift training apparatus comprising a flat base pad having indicia marking the location of the user's leading foot and his trailing foot for a proper golf swing. The user places his feet on a pair of footpads. The leading footpad is elongated and has a fulcrum structure on its lower surface so that the leading foot can rock from side-to-side during a swing.

The trailing footpad has a bottom rib adjacent a lower side edge of the pad so that the upper surface of the footpad is inclined toward the leading footpad, in a non-rocking position. The trailing footpad also has a rotatable toe pad located in the region of the ball of the user's foot. Initially, the user places his weight on the inside of his trailing foot. During a swing, he then rocks his leading foot from an inside position toward an outside position. Upon completion of his swing, the user then shifts his weight to the ball of the trailing foot while rotating the toe pad.

A pylon mounted on the trailing footpad indicates an undesirable lateral back swing of the golfer's hips during the back swing.

Still further objects and advantages of the invention will become readily apparent to those skilled in the art to which the invention pertains, upon reference to the following detailed description.

DESCRIPTION OF THE DRAWINGS

The description refers to the drawings in which like reference characters refer to like parts throughout the several views, and in which.

DESCRIPTION OF THE PREFERRED EMBODIMENT

Figure 1:
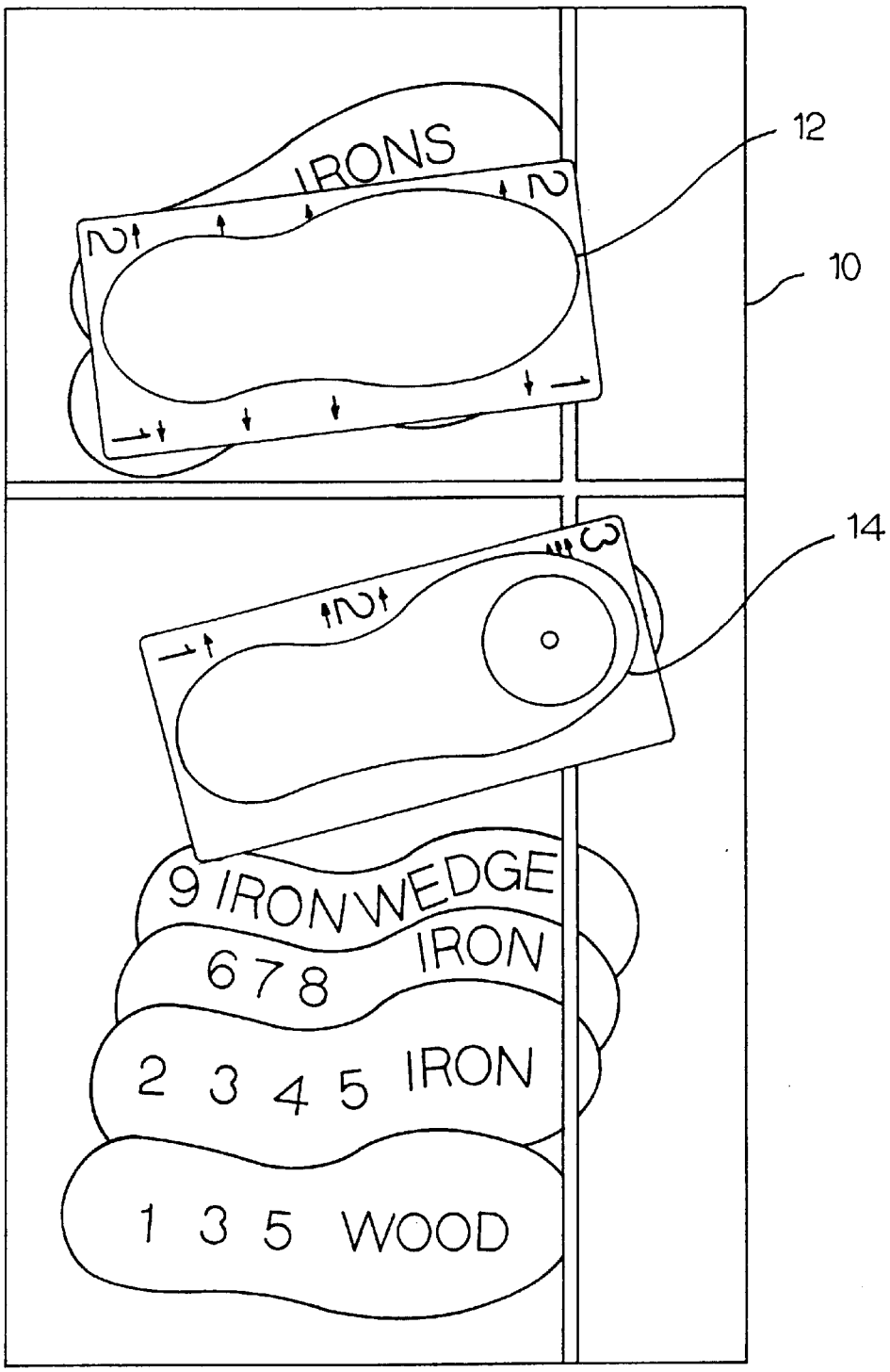
FIG. 1 is a plan view illustrating the preferred footpads mounted on a base pad.

Referring to the drawings, FIG. 1 illustrates a flexible base pad 10 which may be rolled up for storage, a leading footpad 12, and a trailing footpad 14. For illustrative purposes, footpad 12 is referred to as the "leading" footpad because it is closer to the target toward which the golfer is practicing his swing, while footpad 14 is further from the target and may be referred to as the "trailing" footpad.

Figure 3:
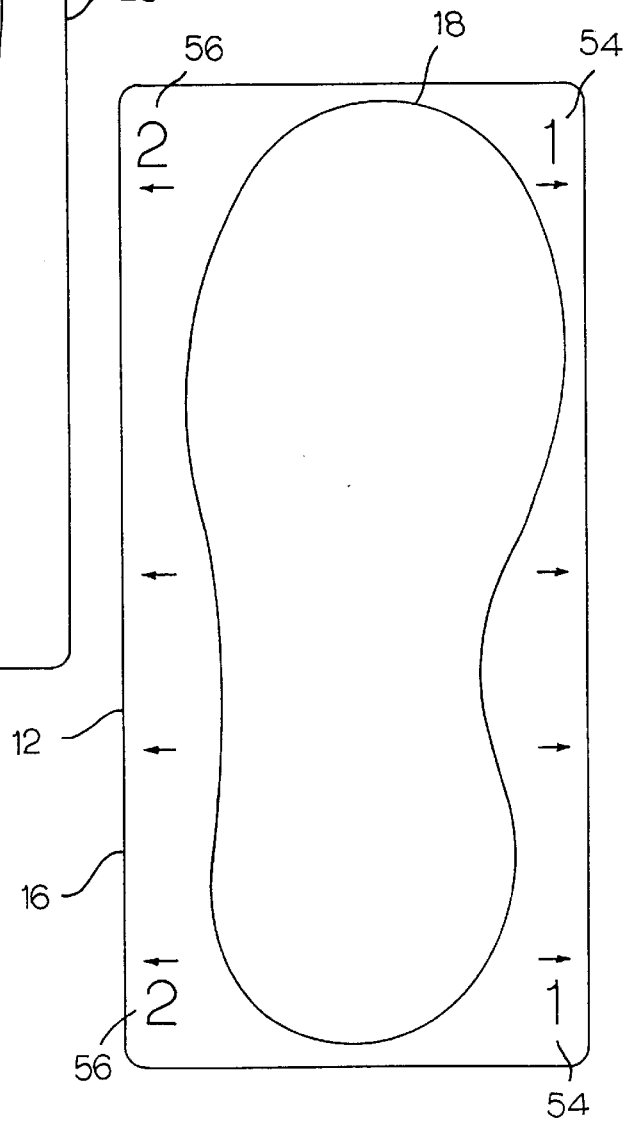
FIG. 3 is a plan view of the leading footpad.

Referring to FIG. 3, leading footpad 12 includes a panel 16 formed of any suitable stiff material of plastic or the like, having a width of 5" and a length of 12". A foot-shaped stabilizer pad 18 comprising any of the commonly known materials simulating artificial grass, is adhesively attached to panel 16 and has the form of the user's shoe. Pad 18 provides a friction-producing material for engaging the user's shoe and clearly indicates where the user should place his shoe.

Figure 4:
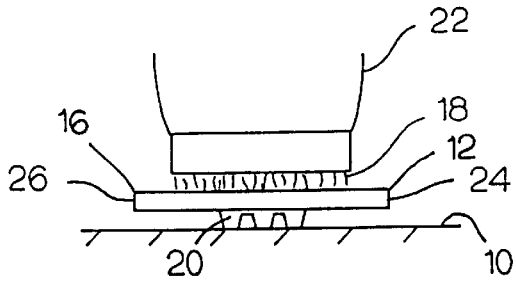
FIG. 4 is a rear view of the leading footpad showing the user's leading foot.
Figure 8:
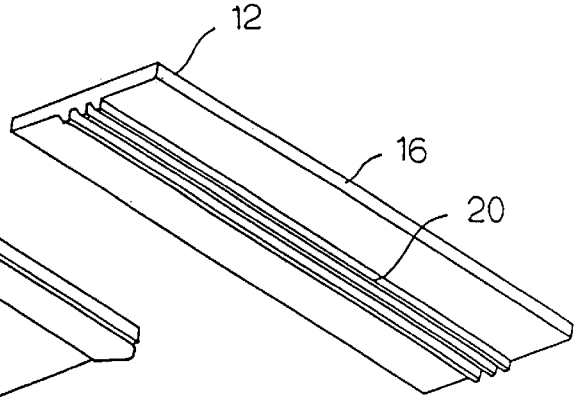
FIG. 8 is a perspective bottom view of the leading footpad.

Referring to FIGS. 4 and 8, panel 16 has a rigid fulcrum structure 20 which extends the full length of panel 16. Fulcrum structure 20 has a width of about 1½", and a depth of ⅜" and, for illustrative purposes, has three elongated parallel ridges.

Fulcrum structure 20 is located along the midsection of panel 16 such that when the user places his shoe 22 on pad 18, as illustrated in FIG. 4, he can rock the footpad by swinging either side edge 24 or side edge 26 toward base pad 10.

Although footpad 12 is described as the leading footpad, for a left handed golfer, the apparatus can be formed such that the right footpad is the leading footpad when the right leg is closer to the target.

Figure 2:
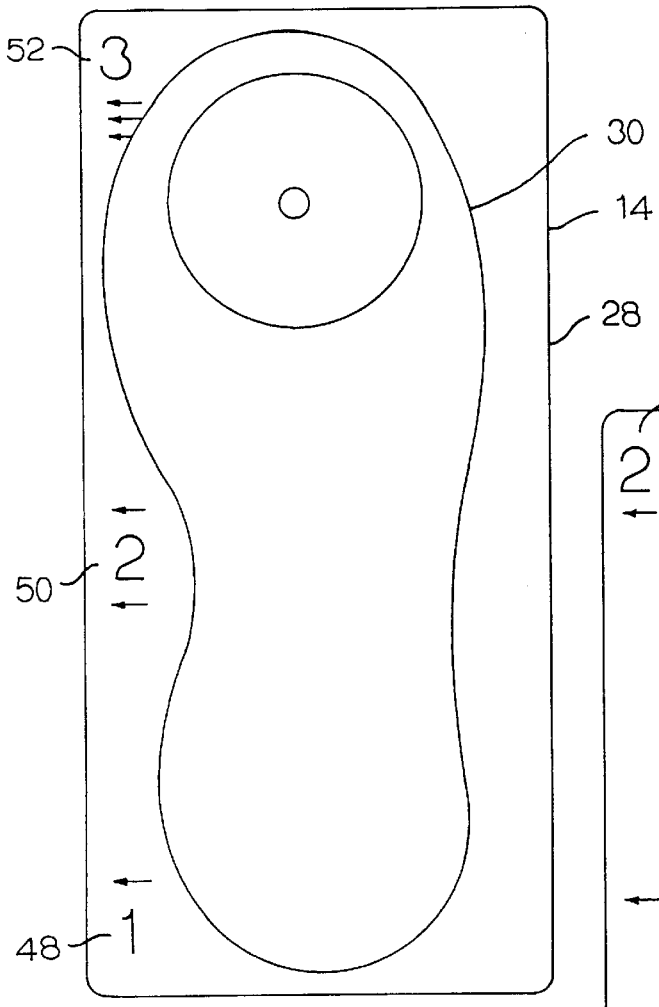
FIG. 2 is a plan view of the trailing footpad.
Figure 7:
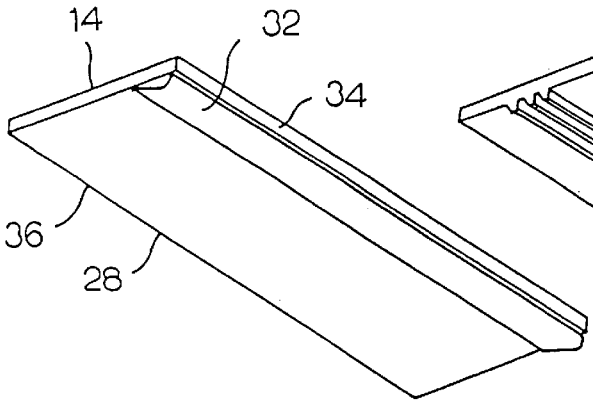
FIG. 7 is a perspective bottom view of the trailing footpad.

Referring to FIGS. 2 and 7, trailing footpad 14 comprises a panel 28 having the same width, length and thickness as panel 16 of the leading footpad. A foot-shaped stabilizer pad 30, formed of a simulated grass material in the shape of the user's right shoe, is adhesively attached to panel 14.

Figure 5:
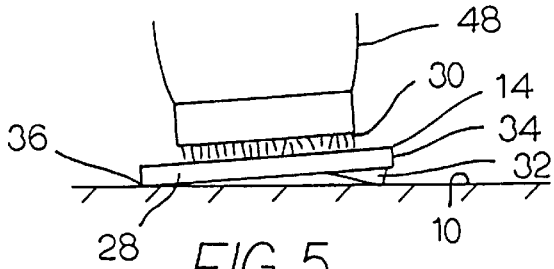
FIG. 5 is a view showing the user's trailing foot.

Referring to FIGS. 5 and 7, an elongated tilt strip 32 is attached to the bottom surface of panel 28, adjacent side edge 34, in such a manner than when panel 28 is mounted on base pad 10, panel 28 will rest on bit strip 32 and left edge 36 of the panel. Preferably the tilt strip is formed of a suitable rigid plastic and is ⅜" in thickness and about 1½" in width. Strip 32 extends the full length of panel 28.

Figure 6:
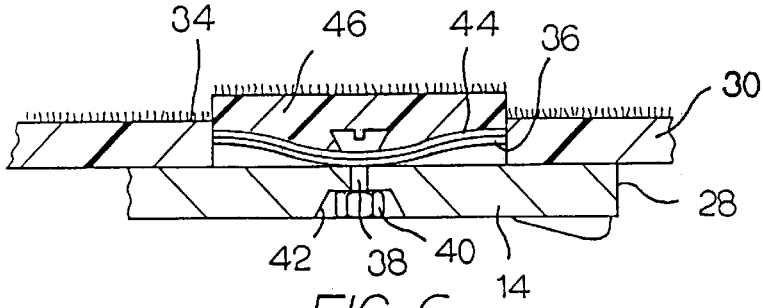
FIG. 6 is an enlarged sectional view showing the rotatable toe pad.

Referring to FIGS. 2 and 6, stabilizer pad 30 has a circular cut out opening 34. A metal disk or washer 36 is fastened to the top surface of panel 28 by threaded fastener means 38. Threaded fastener means 38 includes a lock nut 40 disposed within a bottom recess 42 of panel 28. A second, similarly-shaped metal disk 44 is adhesively attached to a circular toe pad 46 of a grass simulating material so that disk 44 is slidably mounted on disk 36 and rotatable about the axis of fastener means 38.

Toe pad 46 has the same thickness as pad 30, however, it sits about ⅛" higher than pad 30. This permits the user, upon completing his swing, to raise the heel of his shoe and shift his weight to the ball of his foot with respect to the footpad.

Referring to FIGS. 2 and 3, footpad 14 has three indicia labeled respectively 48, 50 and 52 which designate together with appropriate arrows "numbers 1, 2 and 3." Similarly footpad 12 has indicia 54 and 56 which together with the accompanying arrows designate the "numbers 1 and 2". The purpose of these numbers is to assist the user in following the instructions pertaining to a practice swing.

1. During the back swing, the golfer enjoys an assist in the shifting of weight to the inside of the forward foot. Note: The forward foot pad is rocked backward off its' center placed fulcrum.
2. At the start of, and during the downswing, the golfer enjoys an assist in the shifting of weight to the outside of the forward foot. Note: The forward footpad is rocked forward off it's' center placed fulcrum.
3. During the follow through, the golfer enjoys and assists in the spinning of the toe of the rear foot. Note: The rear foot pad facilitates the desired spinning action with the rotation of its'disk insert.

* The golfer's forward is toward, and backward is away from the desired direction of the ball flight.

In use, the user lays base pad 10 in a suitable location and places his leading footpad 12 over the indicia on base pad 10 and his trailing footpad 14 in a position illustrated in FIG. 1, which depends upon the nature of the club he is swinging. He then can practice his swing.

Figure 9:
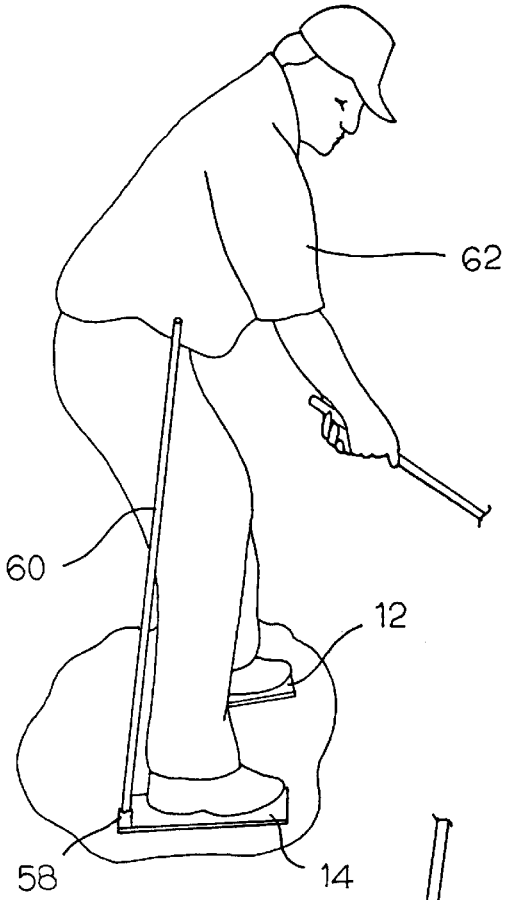
FIG. 9 shows another embodiment of the invention in which a pylon is mounted on the trailing footpad.
Figure 10:
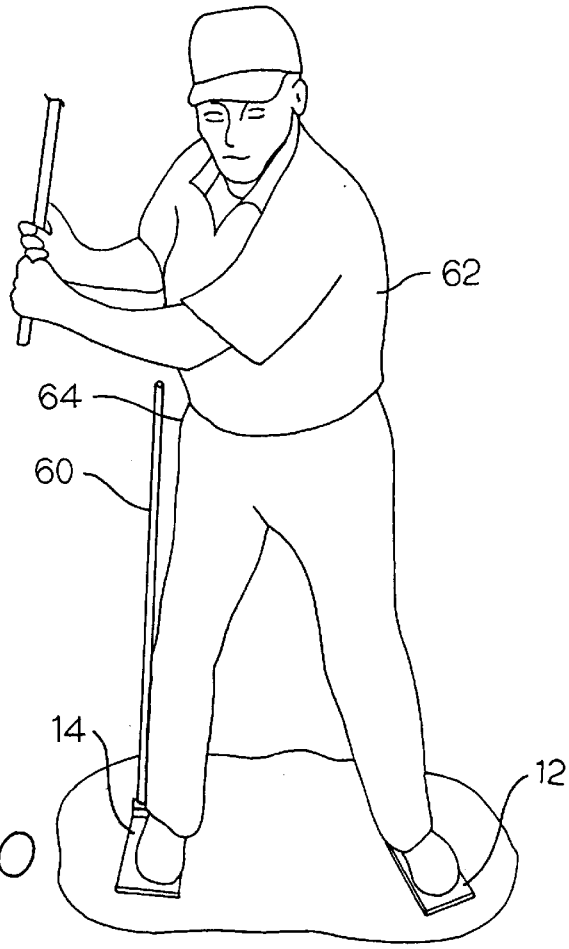
FIG. 10 illustrates the distance between the pylon and the golfer's hips when performing a proper back swing.
Figure 11:
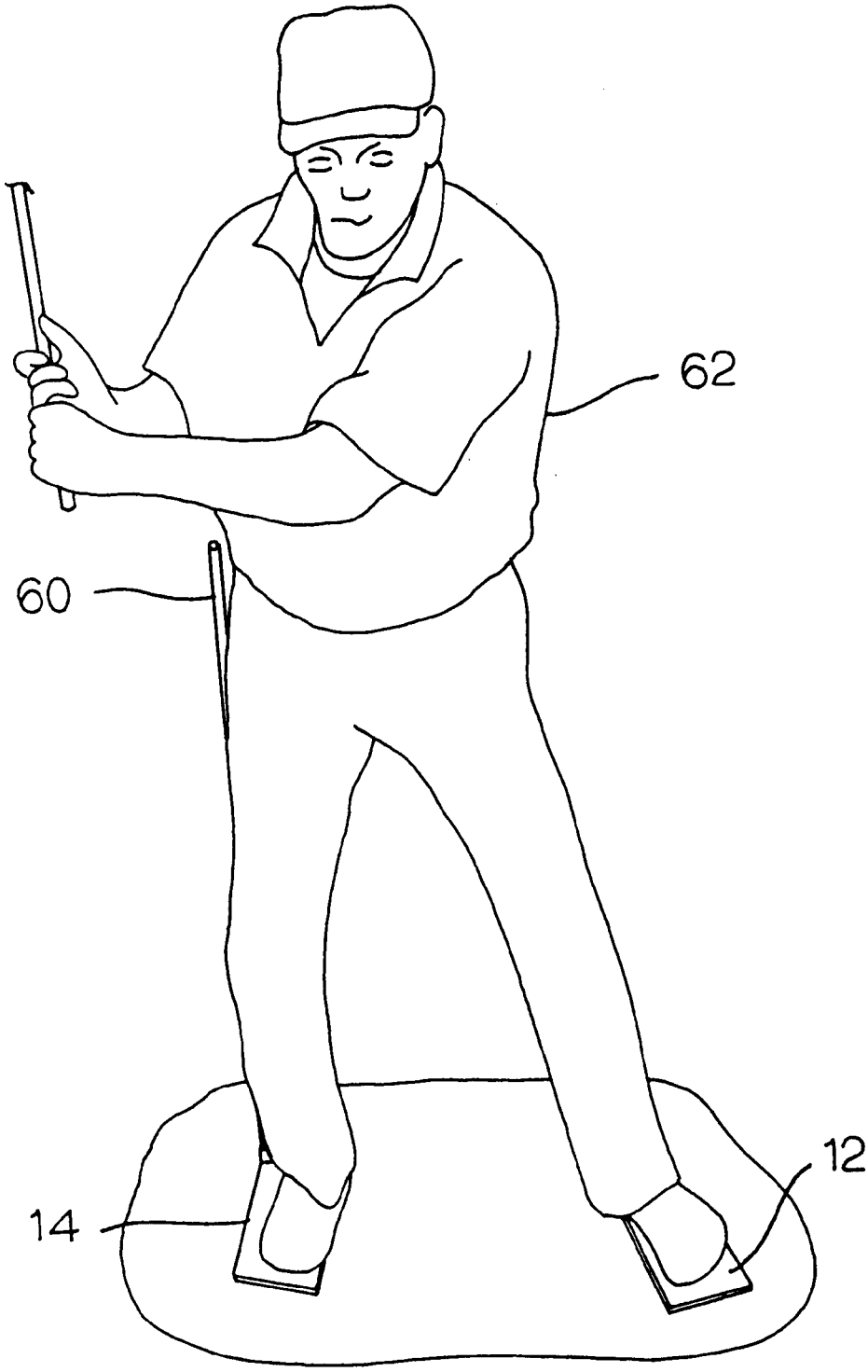
FIG. 11 illustrates the golfer touching the pylon during an undesirable back swing.

Referring to FIGS. 9–11, a modification of the right footpad illustrates a block 58 located on the rear right corner of the trailing footpad for a right-hand golfer. Block 58 has an opening for receiving the lower end of a pylon 60. Pylon 60 is disposed in an upright position and extends waist high to the golfer. The purpose of pylon 60 is to assist the golfer in recognizing that he has an undesirable swing of his hips during a club swing. FIG. 10 illustrates how a proper opening must be kept between the pylon and the user's hips 64 for a proper golf swing. If the user has a tendency to slide his hips as illustrated in FIG. 11, contacting the pylon will remind the golfer that his hips are not in a proper motion.

The pylon extends about 40" above the footpad and is formed of a hollow plastic tube about ⅝" in diameter. It has a slight resiliency so that a user 62 will have his hips located closely adjacent but not touching the pylon. FIG. 10 shows a preferred practice swing in which his hips 64 are located a distance from the pylon. During an incorrect swing illustrated in FIG. 11, the user will shift his hips so that it contacts the pylon.

Having described my invention, I claim:

1. A golf swing training apparatus for training a golfer to properly shift his weight during a club swing, comprising:

a base having a flat upper surface;

a first footpad having an upper foot-engaging surface, a lower surface; a first side edge and a second side edge;

an elongated fulcrum structure mounted on the lower surface of the first footpad for engaging the upper surface of the base, the first footpad being rockable about said fulcrum structure such that one of said side edges is swingable toward the base as the other side edge swings away from the base;

an elongated second footpad having opposite ends, an upper foot-engaging surface, and a lower surface;

bottom structure mounted on the lower surface of the second footpad, such that when the bottom structure engages the base, the upper foot-engaging surface of the second footpad is disposed at an acute angle with respect to the flat upper surface of the base and is inclined toward the first footpad; and the second elongated footpad having opposite ends is disposed for locating a user's foot between the ends thereof, and including a flat toe pad located on the second footpad, and means for supporting the toe pad for rotation about an axis normal to the upper surface of the second footpad, the toe pad being engageable with the user's shoe when it is disposed in a club-swinging position on the second footpad, whereby a golfer having one foot on the first footpad, and his other foot on the second footpad, can rock the first footpad on the fulcrum structure as his other foot is spinning with respect to the second footpad.

2. A golf swing training apparatus as defined in claim 1, including an artificial grass material on the first footpad and the second footpad for engaging the user's shoes.

3. A golf swing training apparatus as defined in claim 1, in which the second footpad has a heel end and a toe end for locating a user's foot therebetween, and including a flat toe pad located on the second footpad adjacent the toe end thereof, and means for supporting the toe pad for rotation about an axis normal to the upper surface of the second footpad, the toe pad being engageable with the user's shoe when it is disposed in a cub-swinging position on the second footpad.

4. A golf swing training apparatus as defined in claim 1, including:

indicia on the flat upper surface of the base for selectively locating the position of the first footpad and the second footpad depending upon a selected golf club.

5. A golf swing training apparatus as defined in claim 1, in which the first footpad receives the leading foot of the user in a rocking motion, and the second footpad receives the trailing foot of the user for a non-rocking motion.

6. A golf swing training apparatus as defined in claim 1, including a pylon supported in a position on one of the footpads adjacent the hip of the trailing foot of the user such that the user contacts the pylon during an improper swinging motion.

* * * * *